United States Patent [19]

Fusselman

[11] Patent Number: 4,641,902

[45] Date of Patent: Feb. 10, 1987

[54] SHIELDED CONNECTOR WITH LATCHES

[75] Inventor: David F. Fusselman, Elizabethtown, Pa.

[73] Assignee: E. I. Du Pont de Nemours and Company, Wilmington, Del.

[21] Appl. No.: 797,475

[22] Filed: Nov. 13, 1985

[51] Int. Cl.[4] ..... H01R 13/629

[52] U.S. Cl. ..... 339/91 R; 339/143 R

[58] Field of Search ..... 339/91 R, 143 R

[56] References Cited

U.S. PATENT DOCUMENTS

| | | | |
|---|---|---|---|
| 3,329,925 | 7/1967 | Johnson et al. | 339/91 |
| 3,760,333 | 9/1973 | Stieler | 339/91 |
| 4,002,389 | 1/1977 | Mammel | 339/91 |
| 4,057,879 | 11/1977 | Eigenbrode | 24/230 |
| 4,367,003 | 1/1983 | Frantz | 339/91 |
| 4,431,244 | 2/1984 | Anhalt et al. | 339/91 R |
| 4,460,230 | 7/1984 | McKee et al. | 339/106 |

FOREIGN PATENT DOCUMENTS

| | | | |
|---|---|---|---|
| 73957 | 3/1983 | European Pat. Off. | 339/143 R |
| 90539 | 10/1983 | European Pat. Off. | 339/143 R |

*Primary Examiner*—John McQuade

[57] ABSTRACT

A shielded connector for electrical circuits comprising a non-conducting housing containing electrically conductive terminals and an electrically conductive housing, said electrically conductive housing comprising at least two elements, each of said elements being capable of mating with the other of said elements, at least one of said elements having at least one recessed pocket having an aperture open to the exterior of said element, each of said pockets being adapted to hold a projection on a latch, the interior walls of said pocket being continuous with the exterior walls of said electrically conductive housing and either a portion of said pocket also being located in a second element or at least one wall of said pocket being contributed by a second element.

20 Claims, 6 Drawing Figures

FIG. 2
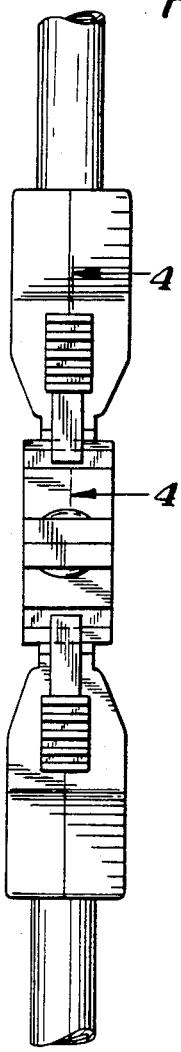
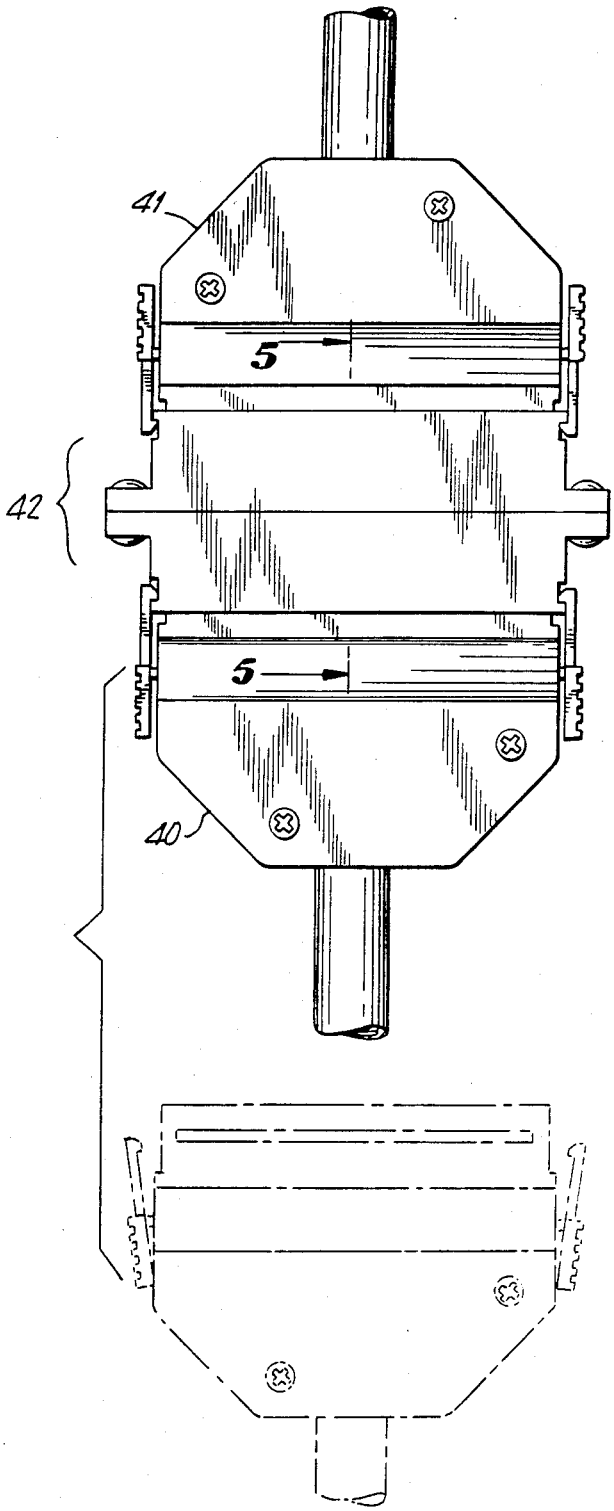
FIG. 3

SHIELDED CONNECTOR WITH LATCHES

The present invention relates to electrical connectors having a housing for shielding the connections therein in order to prevent the emission of electromagnetic energy.

Although the use of a latching means to connect a first connector to a second connector is known in the art, a shielded connector that provides the option of using latches or not using latches in the same connector, while at the same time maintaining the shield against emissions of electromagnetic energy, is not available.

The unique design of the connector of the present invention provides a shielded connector that may be used with or without latches for binding it to another connector. Significantly, whether or not latches are used, the shield against emissions of electromagnetic energy is maintained. The connector also shields the internal components from ambient electromagnetic radiation.

For a more detailed understanding of the invention and for an illustration of a preferred form thereof, reference is made to the drawing in which:

FIG. 2 is an end view of two attached connectors of the present invention (attached via an adapter).

FIG. 3 is a side view of two attached connectors of the present invention (attached via an adapter).

Figure 1:
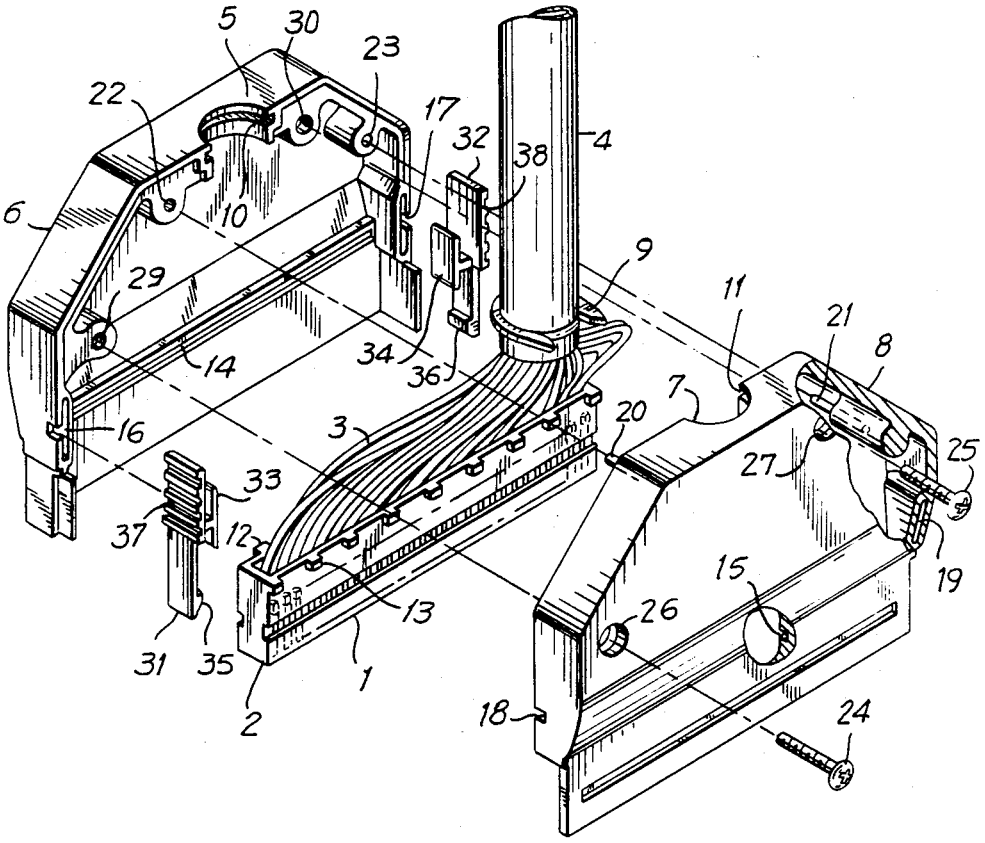
FIG. 1 is an exploded perspective view of a connector of the present invention.
Figure 4:
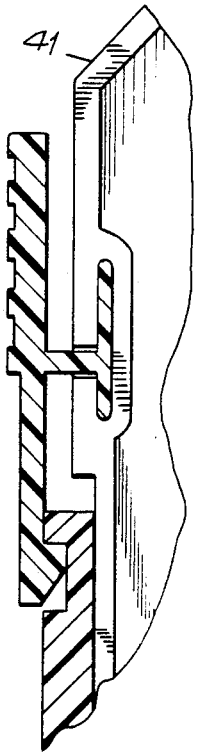
FIG. 4 is a fragmentary cross sectional view taken along the lines 4—4 of FIG. 2.
Figure 5:
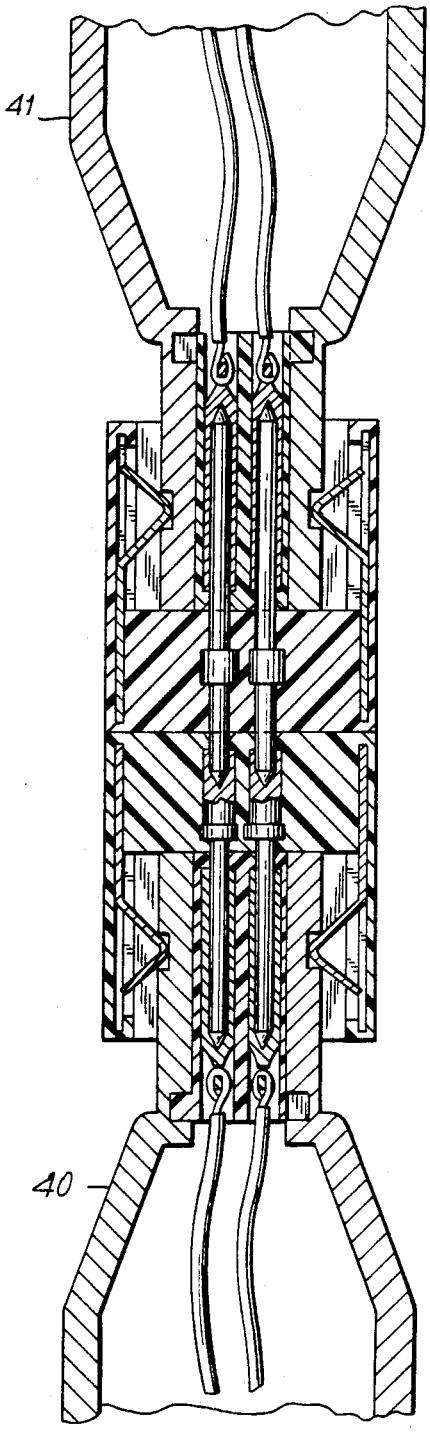
FIG. 5 is a fragmentary cross sectional view taken along the lines 5—5 of FIG. 3.

The present invention relates to a shielded connector for electrical circuits comprising a nonconducting housing (preferably made of plastic) containing electrically conductive terminals, said terminals being connectable to electrically conductive cable, and an electrically conductive housing (preferably made of metal or metallized plastic) that shields said nonconducting housing. The terminals may be male (e.g., pins), female (e.g., receptacles), or hermaphroditic. The electrically conductive housing has an aperture for inserting a cable and consists of at least two separable elements and preferably consists of only two elements (not including fastening means, such as screws, for holding the two elements together). Each element is capable of mating with the other element(s) to form the conductive housing. The conductive housing has one or more pockets, preferably two pockets. Each pocket has an aperture open to the exterior of the conductive housing.

When the elements of the conductive housing are mated, there are no openings in the pocket except for the aperture because the walls of the pocket are otherwise continuous with the exterior walls of the electrically conductive housing. A pocket may be located anywhere on an element of the electrically conductive housing so long as the pocket is open only to the exterior of the electrically conductive housing and it is in contact with the interface where two elements of said housing mate. Thus, part of the pocket can be located in one element and part of the pocket can be located in the second element. It is also possible for the entire pocket, less one wall, to be located in one element and the remaining wall to be supplied by the second element.

There will preferably be one or more apertures in the exterior surface of at least one of the elements extending completely through the element. When the elements are mated, each such aperture should line up with a corresponding second aperture on a mating element. It is not necessary for said second aperture to extend completely through the mating element and, in fact, it is preferable that it not extend completely through. These apertures make it possible to use fastening means, such as screws, to fasten the elements together.

Each element will also preferably have one or more (more preferably two) projections on its surface that is at the interface with another element that are adapted to be inserted into apertures on the mating surface of another element. These projections help to align the elements when they are mated.

Each pocket is shaped so that a projection from a latch will be held securely by the pocket when the two elements of the housing are mated.

Preferably, each pocket is constructed so that it extends in at least two directions away from the aperture within a plane that is parallel to the exterior surface of the element which forms said aperture. It is also preferred that there be two elements and two pockets with approximately half of each pocket being in each element.

The pockets are preferably located so that they are at opposite ends of the conducting housing and as far apart as possible and are adjacent to the distal end of the connector.

Each latch is aligned with the longitudinal axis of the connector. This is the axis along which the connector is inserted into a second connector. As used herein, the distal end of the connector shall mean that end that is closest to said second connector and the proximal end of the connector shall mean that end of the connector that is furthest from the second connector. Similarly, the distal end of a latch shall be that end disposed in the direction of said second connector, while the proximal end of said latch shall be its opposite end.

The latches should be made of a resilient material. They may be metal or plastic. Each latch will have a projection at right angles to a line extending between its distal and proximal ends. At the point where the projection is attached to the main body of the latch, the projection should be slightly smaller in its cross section than the aperture into which it will be fitted. However, at the point where the projection extends beyond the aperture and into the pocket, the cross section of the latch should be larger and should preferably be only slightly smaller than the pocket. Accordingly, the latch may be inserted into the pocket before the elements of the housing are mated, and once the elements are mated, it should not be possible to remove the latch from the pocket.

The distal end of the latch will preferably have a second projection that is adapted to be inserted into an aperture either on a second connector or on a housing having electrically conductive pins or receptacles that mate with the pins or receptacles of the first housing. The shape of said second projection should be such that it fits snugly within the aperture on the second connector. Preferably, the second projection will be angled slightly toward the distal end of the latch so that when said second projection is inserted into its corresponding aperture it is removable only with some difficulty.

The proximal end of the latch preferably has several projections or ridges that form a gripping surface that may be functionally engaged by human fingers. This aids a person desiring to bend the latch so that said second projection is removed from said second connector and also aids in pulling two connectors apart.

FIG. 1 illustrates a preferred embodiment of the present invention. The shielded connector shown in FIG. 1 consists of a plastic housing 1 containing electrically conductive receptacles 2. These receptacles are connected to individually insulated wires 3 that merge into an electrically conductive cable 4. Cable 4 fits snugly within a semicircular aperture 5 in a first element 6 of a metal housing. A corresponding semicircular aperture 7 appears in a second element 8 of the metal housing. A U-shaped retaining collar 9 also serves to hold cable 4 snugly. Collar 9 fits into a groove 10 on first element 6 when the elements are mated and the ends of the U extend into the corresponding groove (groove 11) on element 8. Plastic housing 1 also fits snugly in a recess formed by the walls of first element 6. First projections 12 on plastic housing 1 fit into first groove 14 on first element 6 and second projections 13 on plastic housing 1 fit into corresponding second groove 15 on second element 8. The projections help keep plastic housing 1 firmly in place. Portions of two pockets 16 and 17 are formed within the walls of first element 6 of the metal housing and their corresponding portions 18 and 19 are formed within the walls of second element 8.

When elements 6 and 8 are mated, the pocket portions 16 and 18 combine to form a first pocket and pocket portions 17 and 19 combine to form a second pocket. Also, the semicircular apertures 5 and 7 combine to form a circular aperture that holds cable 4 snugly. Plastic housing 1 is also held securely when elements 6 and 8 are mated. Elements 6 and 8, when mated, are prevented from slipping sideways by projections 20 and 21 on second element 8 that fit into corresponding recesses 22 and 23 on first element 6. Apertures 22 and 23 are holes in the interior wall of element 6 that do not extend through to the outside wall. Screws 24 and 25 are inserted through holes 26 and 27 in second element 8 into threaded apertures 29 and 30 on the interior surface of first element 6 to hold elements 6 and 8 tightly together. Threaded apertures 29 and 30 do not extend completely through to the other side of element 6. It will be seen from the foregoing description that, except for collar 9 in groove 10, and the projections and screws and corresponding apertures that function to hold elements 6 and 8 together, the two elements are substantially identical.

Also shown in FIG. 1 are two latches, first latch 31 and second latch 32. Before elements 6 and 8 are mated, a projection 33 on first latch 31 is inserted into pocket portion 16 and a projection 34 on second latch 32 is inserted into pocket portion 17. Also shown, is projection 35 on latch 31 for insertion into a second connector. There is a corresponding projection 36 on latch 32. Each of latches 31 and 32 also has a series of ridges 37 and 38 that provides a surface that may be operatively engaged by a person's finger.

FIGS. 2–5 present different views illustrating how two connectors of the present invention 40 and 41 may be connected together via an adapter 42.

Figure 6:
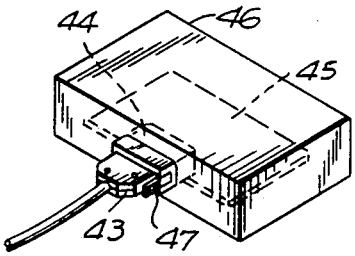
FIG. 6 is a perspective view of a connector of the present invention attached to a second connector that is, in turn, mounted on a circuit board in a metal housing.

FIG. 6 shows how a connector 43 of the present invention may be connected to a connector 44 which is mounted on a circuit board 45 within a metal housing 46. The two connectors are held together by two latches. One of the latches, latch 47, is shown in the Figure.

While the above description and attached drawings illustrate certain embodiments of the present invention, it will be apparent that other embodiments and modifications may be made that are equivalent thereto and will be obvious to one skilled in the art, and the invention is not to be limited except by the appended claims.

I claim:

1. A shielded connector for electrical circuits comprising:

a non-conductive housing containing electrically conductive terminals, said terminals being connectable to an electrically conductive cable, an electrically conductive housing surrounding and sheilding said non-conductive housing, said electrically conductive housing comprising at least two elements, each of said elements being capable of mating with the other of said elements to form said electrically conductive housing and surround said non-electrically conductive housing;

an opening formed in said electrically conductive housing adapted for insertion of the electrically conductive cable;

at least one pocket formed in a sidewall of said electrically conductive housing, at least a portion of said pocket being formed in each element so that when said elements are mated to form the electrically conductive housing, said pocket will be completely enclosed, except for an aperture, within said sidewall between its inner and exterior surfaces, said aperture being located in the exterior surface of said sidewall, at least one latch having a projection adapted to be inserted into the portion of the pocket formed by each element prior to mating so that after the elements are mated to form the electrically conductive housing, said projection will be located within the pocket and will act to retain the latch adjacent the external surface of the conductive housing sidewall, the latch also being adapted to mate said shielded connector with a second connector.

2. A connector according to claim 1, wherein said pocket extends in at least two directions within a plane parallel to said sidewall of the electrically conductive housing.

3. A connector according to claim 1, wherein said electrically conductive housing consists of two elements.

4. A connector according to claim 3, wherein said elements are substantially identical.

5. A connector accroding to claim 1 wherein each element has along a surface facing the other element means for aligning both elements together for mating.

6. A connector according to claim 5 wherein each element also has along said surface facing the other element means for positioning and securing the non-conductive housing within the electrically conductive housing.

7. A connector according to claim 1, wherein said non-conducting housing is made of plastic.

8. A connector according to claim 1, wherein said electrically conductive housing is made of metal.

9. A connector according to claim 1, wherein said electrically conductive housing has two pockets in separate sidewalls formed by mating said two elements, each of said elements having a portion of each pocket, two complete pockets being formed at the interface between the elements when the elements are mated, the two pockets being on a line that falls within the plane formed by the mating surfaces of said elements, said line being perpendicular to the longitudinal axis of said shielded cable connector.

10. A connector according to claim 9, wherein each said pocket extends in at least two directions within a plane parallel to its respective sidewalls of the electrically conductive housing.

11. A connector according to claim 10, wherein said elements are substantially identical.

12. A connector according to claim 9, wherein said elements are substantially identical.

13. A connector according to claim 1, wherein each element further includes at least one hole which is adapted to the use of fastening means for fastening the elements together.

14. A connector according to claim 1, wherein said latch is made of a resilient material.

15. A connector according to claim 14, wherein said latch extends along a line parallel to the longitudinal axis of said shielded connector and the projection from said latch is inserted along a line perpendicular to said axis.

16. A connector according to claim 15, wherein the proximal end of said latch comprises projections that form a gripping surface that may be functionally engaged by human fingers.

17. A connector according to claim 15, wherein the distal end of said latch comprises a projection adapted to be inserted into an aperture on said second connector.

18. A connector according to claim 9, said connector comprising two latches made of a resilient material, each latch being inserted into one of said pockets.

19. A connector according to claim 18, wherein each said latch extends along a line parallel to the longitudinal axis of said shielded connector and the projection from each said latch is inserted along a line perpendicular to said axis.

20. A connector according to claim 19, wherein the distal end of each said latch comprises a projection adapted to be inserted into an aperture on said second connector.

* * * * *